US007055989B2

(12) United States Patent
Galli

(10) Patent No.: US 7,055,989 B2
(45) **Date of Patent: *Jun. 6, 2006**

(54) LED LIGHTING ASSEMBLY

(76) Inventor: Robert Galli, 8176 Horseshoe Bend La., Las Vegas, NV (US) 89113

( * ) Notice: Subject to any disclaimer, the term of this patent is extended or adjusted under 35 U.S.C. 154(b) by 106 days.

This patent is subject to a terminal disclaimer.

(21) Appl. No.: 10/796,360

(22) Filed: Mar. 9, 2004

(65) Prior Publication Data

US 2004/0190285 A1 Sep. 30, 2004

Related U.S. Application Data

(63) Continuation-in-part of application No. 10/659,575, filed on Sep. 10, 2003, now Pat. No. 6,942,365, which is a continuation-in-part of application No. 10/315,336, filed on Dec. 10, 2002, now Pat. No. 6,827,468.

(60) Provisional application No. 60/338,893, filed on Dec. 10, 2001.

(51) Int. Cl.
*F21V 29/00* (2006.01)

(52) U.S. Cl. ..... 362/294; 362/373; 362/545; 362/800

(58) Field of Classification Search ..... 362/294, 362/200, 800, 202
See application file for complete search history.

(56) References Cited

U.S. PATENT DOCUMENTS

| | | | | |
|---|---|---|---|---|
| 6,407,411 | B1 * | 6/2002 | Wojnarowski et al. | 257/99 |
| 6,481,874 | B1 * | 11/2002 | Petroski | 362/373 |
| 6,541,800 | B1 * | 4/2003 | Barnett et al. | 257/98 |
| 2003/0095408 | A1 * | 5/2003 | Opolka | 362/241 |

* cited by examiner

*Primary Examiner*—Ali Alavi
*Assistant Examiner*—Hargobind S. Sawhney
(74) *Attorney, Agent, or Firm*—Barlow, Josephs & Holmes, Ltd.

(57) ABSTRACT

The present invention provides a lighting head assembly that incorporates a high intensity LED package into an integral housing for further incorporation into other useful lighting devices. The present invention primarily includes two housing components, namely an inner mounting die and an outer enclosure. The inner and outer components cooperate to retain the LED package, provide electrical and control connections, provide integral heat sink capacity and includes an integrated reflector cup. In this manner, high intensity LED packages can be incorporated into lighting assemblies through the use of the present invention by simply installing the present invention into a housing and providing power connections thereto.

10 Claims, 14 Drawing Sheets

LED LIGHTING ASSEMBLY

CROSS-REFERENCE TO RELATED APPLICATIONS

This application is related to and claims priority from earlier filed provisional patent application No. 60/338,893, filed Dec. 10, 2001 and is a continuation-in-part of U.S. patent application Ser. No. 10/659,575, filed Sep. 10, 2003 now U.S. Pat. No 6,942,365, which is a continuation-in-part of U.S. patent application Ser. No. 10/315,336, filed Dec. 10, 2002 now U.S. Pat. No. 6,827,468.

BACKGROUND OF THE INVENTION

The present invention relates to a new assembly for packaging a high intensity LED lamp for further incorporation into a lighting assembly. More specifically, this invention relates to an assembly for housing a high intensity LED lamp that provides integral electrical connectivity, integral heat dissipation and an integral reflector device in a compact and integrated package for further incorporation into a lighting device and more specifically for use in a flashlight.

Currently, several manufacturers are producing high brightness light emitting diode (LED) packages in a variety of forms. These high brightness packages differ from conventional LED lamps in that they use emitter chips of much greater size, which accordingly have much higher power consumption requirements. In general, these packages were originally produced for use as direct substitutes for standard LED lamps. However, due to their unique shape, size and power consumption requirements they present manufacturing difficulties that were originally unanticipated by the LED manufacturers. One example of a high brightness LED of this type is the Luxeon™ Emitter Assembly LED (Luxeon is a trademark of Lumileds Lighting, LLC). The Luxeon LED uses an emitter chip that is four times greater in size than the emitter chip used in standard LED lamps. While this LED has the desirable characteristic of producing a much greater light output than the standard LED, it also generates a great deal more heat than the standard LED. If this heat is not effectively dissipated, it may cause damage to the emitter chip and the circuitry required to drive the LED.

Often, to overcome the buildup of heat within the LED, a manufacturer will incorporate a heat dissipation pathway within the LED package itself. The Luxeon LED, for example, incorporates a metallic contact pad into the back of the LED package to transfer the heat out through the back of the LED. In practice, it is desirable that this contact pad in the LED package be placed into contact with further heat dissipation surfaces to effectively cool the LED package. In the prior art attempts to incorporate these packages into further assemblies, the manufacturers that used the Luxeon LED have attempted to incorporate them onto circuit boards that include heat transfer plates adjacent to the LED mounting location to maintain the cooling transfer pathway from the LED. While these assemblies are effective in properly cooling the LED package, they are generally bulky and difficult to incorporate into miniature flashlight devices. Further, since the circuit boards that have these heat transfer plates include a great deal of heat sink material, making effective solder connections to the boards is difficult without applying a large amount of heat. The Luxeon LED has also been directly mounted into plastic flashlights with no additional heat sinking. Ultimately however, these assemblies malfunction due to overheating of the emitter chip, since the heat generated cannot be dissipated.

There is therefore a need for an assembly that provides for the mounting of a high intensity LED package that includes a great deal of heat transfer potential in addition to providing a means for further incorporating the LED into the circuitry of an overall lighting assembly.

BRIEF SUMMARY OF THE INVENTION

In this regard, the present invention provides an assembly that incorporates a high intensity LED package, such as the Luxeon Emitter Assembly described above, into an integral housing for further incorporation into other useful lighting devices. The present invention can be incorporated into a variety of lighting assemblies including but not limited to flashlights, specialty architectural grade lighting fixtures and vehicle lighting. The present invention primarily includes two housing components, namely an inner mounting die, and an outer enclosure. The inner mounting die is formed from a highly thermally conductive material. While the preferred material is brass, other materials such as thermally conductive polymers or other metals may be used to achieve the same result. The inner mounting die is cylindrically shaped and has a recess in the top end. The recess is formed to frictionally receive the mounting base of a high intensity LED assembly. A longitudinal groove is cut into the side of the inner mounting die that may receive an insulator strip or a strip of printed circuitry, including various control circuitry thereon. Therefore, the inner mounting die provides both electrical connectivity to one contact of the LED package and also serves as a heat sink for the LED. The contact pad at the back of the LED package is in direct thermal communication with the inner surface of the recess at the top of the inner mounting die thus providing a highly conductive thermal path for dissipating the heat away from the LED package.

The outer enclosure of the present invention is preferably formed from the same material as the inner mounting die. In the preferred embodiment, this is brass but may be thermally conductive polymer or other metallic materials. The outer enclosure slides over the inner mounting die and has a circular opening in the top end that receives the clear optical portion of the Luxeon LED package therethrough. The outer enclosure serves to further transfer heat from the inner mounting die and the LED package, as it is also highly thermally conductive and in thermal communication with both the inner mounting die and the LED package. The outer enclosure also covers the groove in the side of the inner mounting die protecting the insulator strip and circuitry mounted thereon from damage.

Another feature of the outer enclosure of the present invention is that the end that receives the optical portion of the LED package also serves as a reflector for collecting the light output from the LED package and further focusing and directing it into a collimated beam of light. After assembly, it can be seen that the present invention provides a self contained packaging system for the Luxeon Emitter Assembly or any other similar packaged high intensity LED device. Assembled in this manner, the present invention can be incorporated into any type of lighting device.

Accordingly, one of the objects of the present invention is the provision of an assembly for packaging a high intensity LED. Another object of the present invention is the provision of an assembly for packaging a high intensity LED that includes integral heat sink capacity. A further object of the present invention is the provision of an assembly for packaging a high intensity LED that includes integral heat sink capacity while further providing means for integral electrical connectivity and control circuitry. Yet a further object of the present invention is the provision of an assembly for packaging a high intensity LED that includes integral heat sink capacity, a means for electrically connectivity and an integral reflector cup that can creates a completed flashlight head for further incorporation into a flashlight housing or other lighting assembly.

Other objects, features and advantages of the invention shall become apparent as the description thereof proceeds when considered in connection with the accompanying illustrative drawings.

BRIEF DESCRIPTION OF THE DRAWINGS

In the drawings which illustrate the best mode presently contemplated for carrying out the present invention.

DETAILED DESCRIPTION OF THE INVENTION

Figure 1:
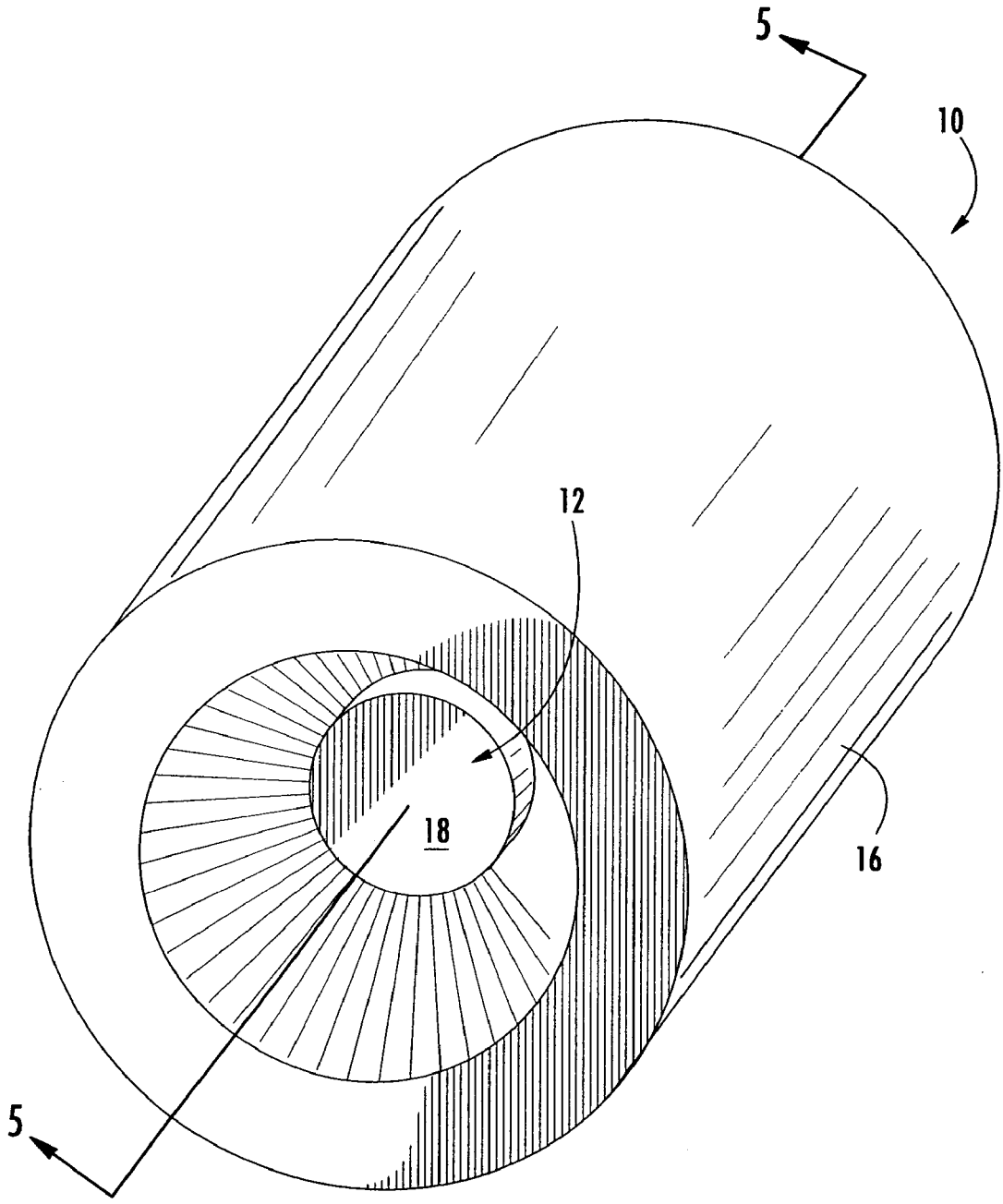
FIG. 1 is a perspective view of the LED lighting assembly of the present invention.

Referring now to the drawings, the light emitting diode (LED) lighting assembly of the present invention is illustrated and generally indicated at 10 in FIGS. 1–5. Further, a schematic diagram is shown in FIG. 6 generally illustrating the present invention incorporated into a flashlight circuit. As will hereinafter be more fully described, the present invention illustrates an LED lighting assembly 10 for further incorporation into a lighting device. For the purposes of providing a preferred embodiment of the present invention, the device 10 will be shown incorporated into a flashlight, however, the present invention also may be incorporated into any other lighting device such as architectural specialty lighting or vehicle lighting. In general, the present invention provides a means for packaging a high intensity LED lamp that includes integral heat sink capacity, electrical connectivity and an optical assembly for controlling the light output from the LED. The present invention therefore provides a convenient and economical assembly 10 for incorporating a high intensity LED into a lighting assembly that has not been previously available in the prior art.

Figure 2:
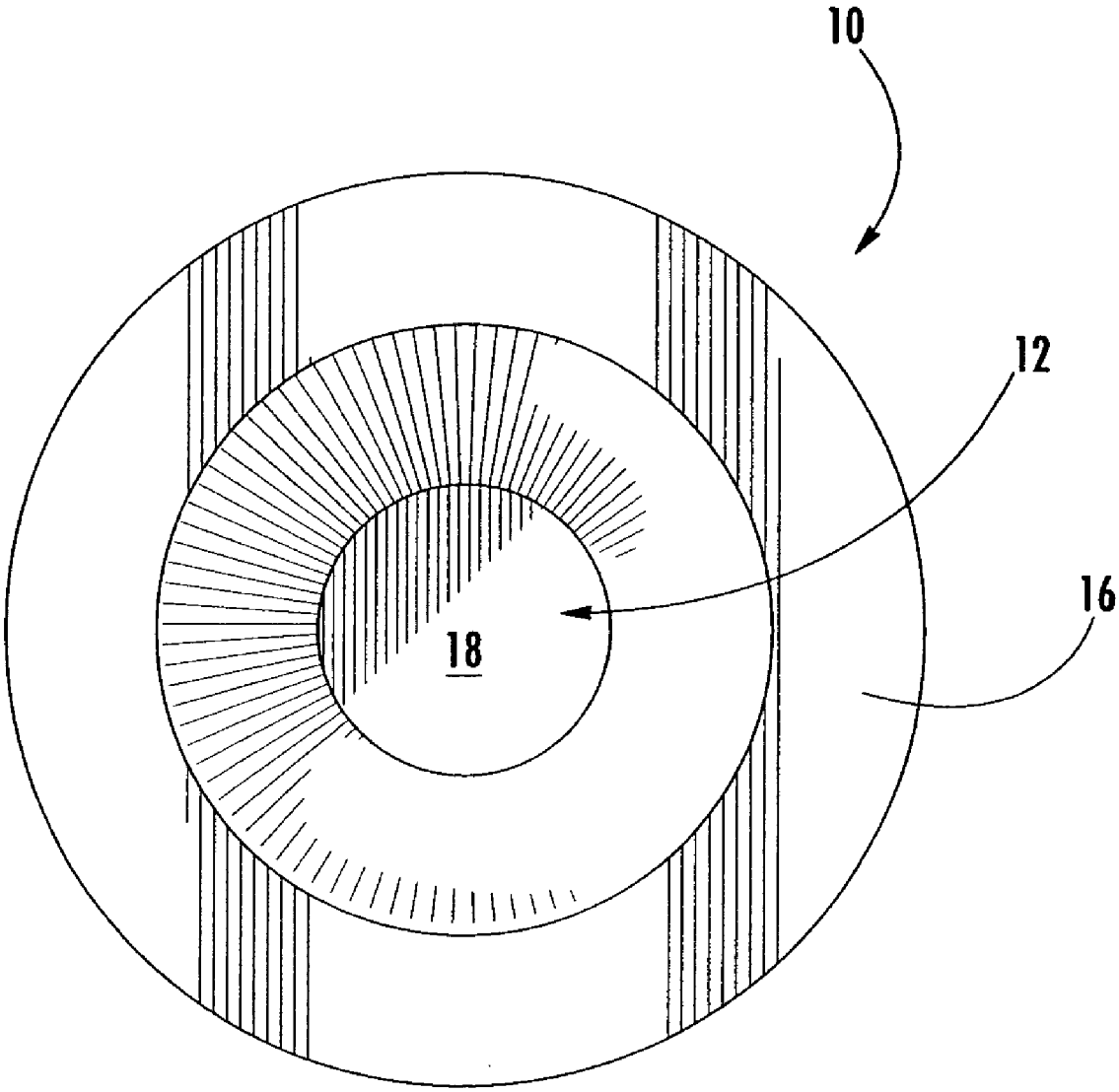
FIG. 2 is a front view thereof.
Figure 3:
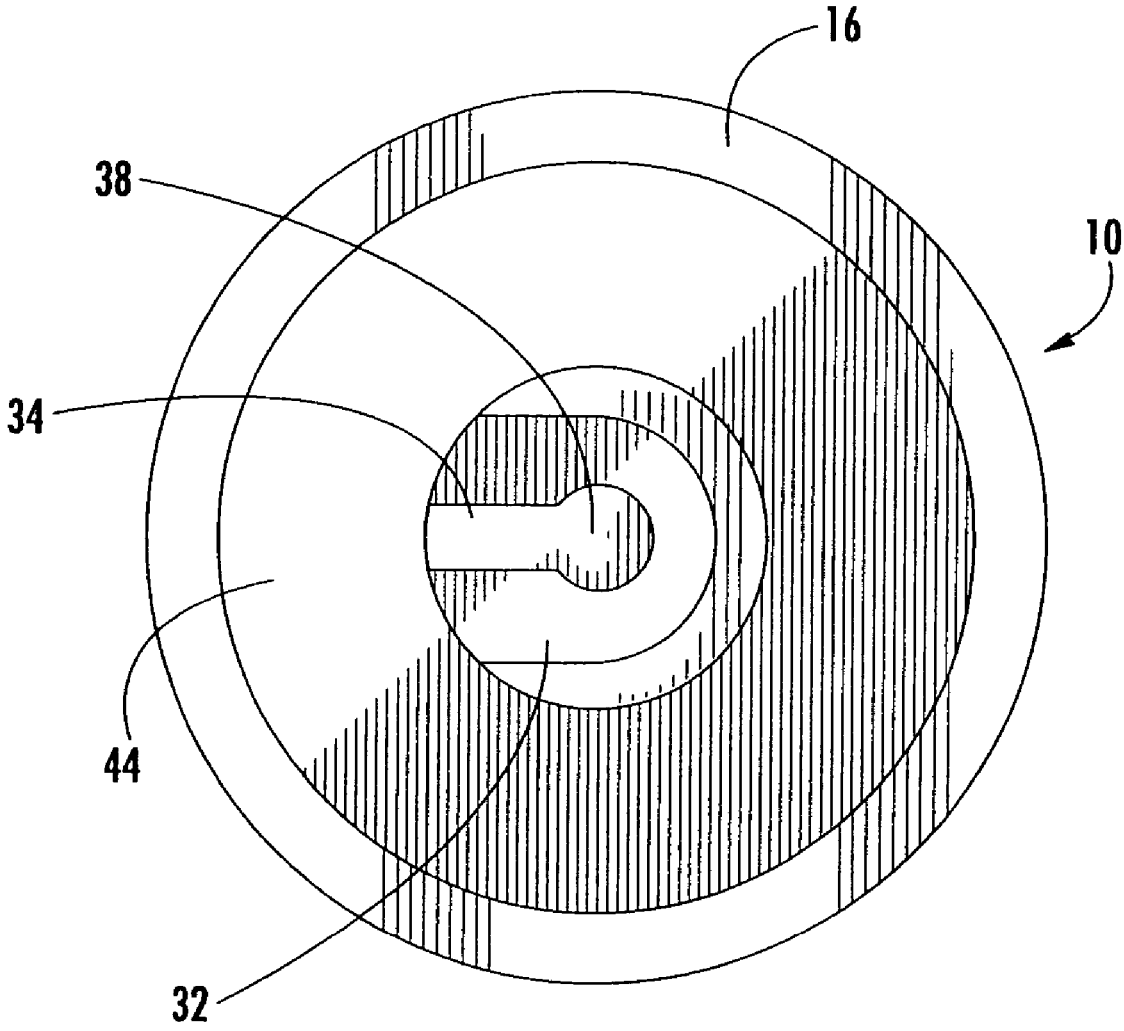
FIG. 3 is rear view thereof.

Turning to FIGS. 1, 2 and 3, the LED package assembly 10 can be seen in a fully assembled state. The three main components can be seen to include a high intensity LED lamp 12, an inner mounting die 14 and an outer enclosure 16. In FIGS. 1 and 2, the lens 18 of the LED 12 can be seen extending through an opening in the front wall of the outer enclosure 16. Further, in FIG. 3 a rear view of the assembled package 10 of the present invention can be seen with a flexible contact strip shown extending over the bottom of the interior die 14.

Figure 4:
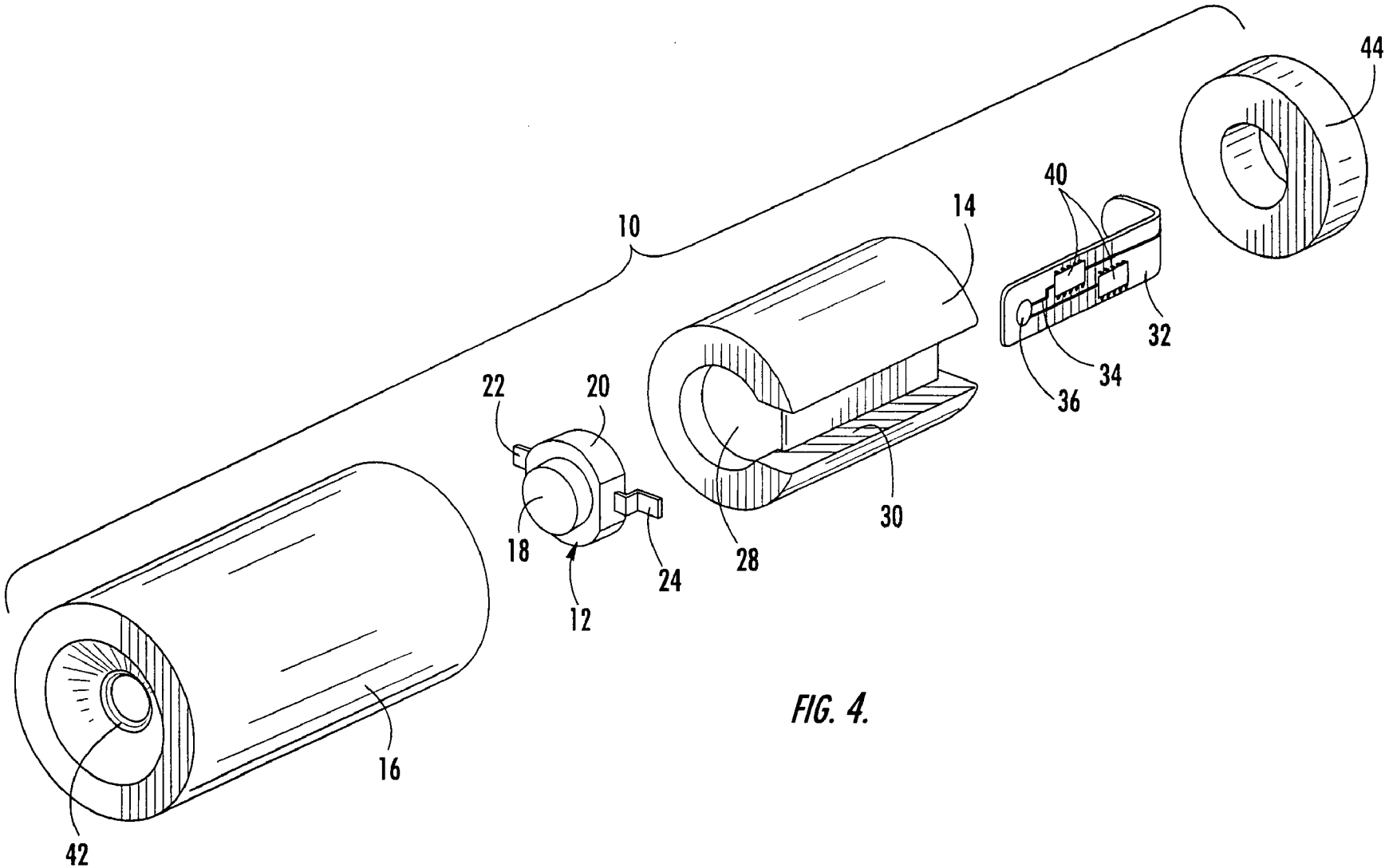
FIG. 4 is an exploded perspective thereof.
Figure 5:
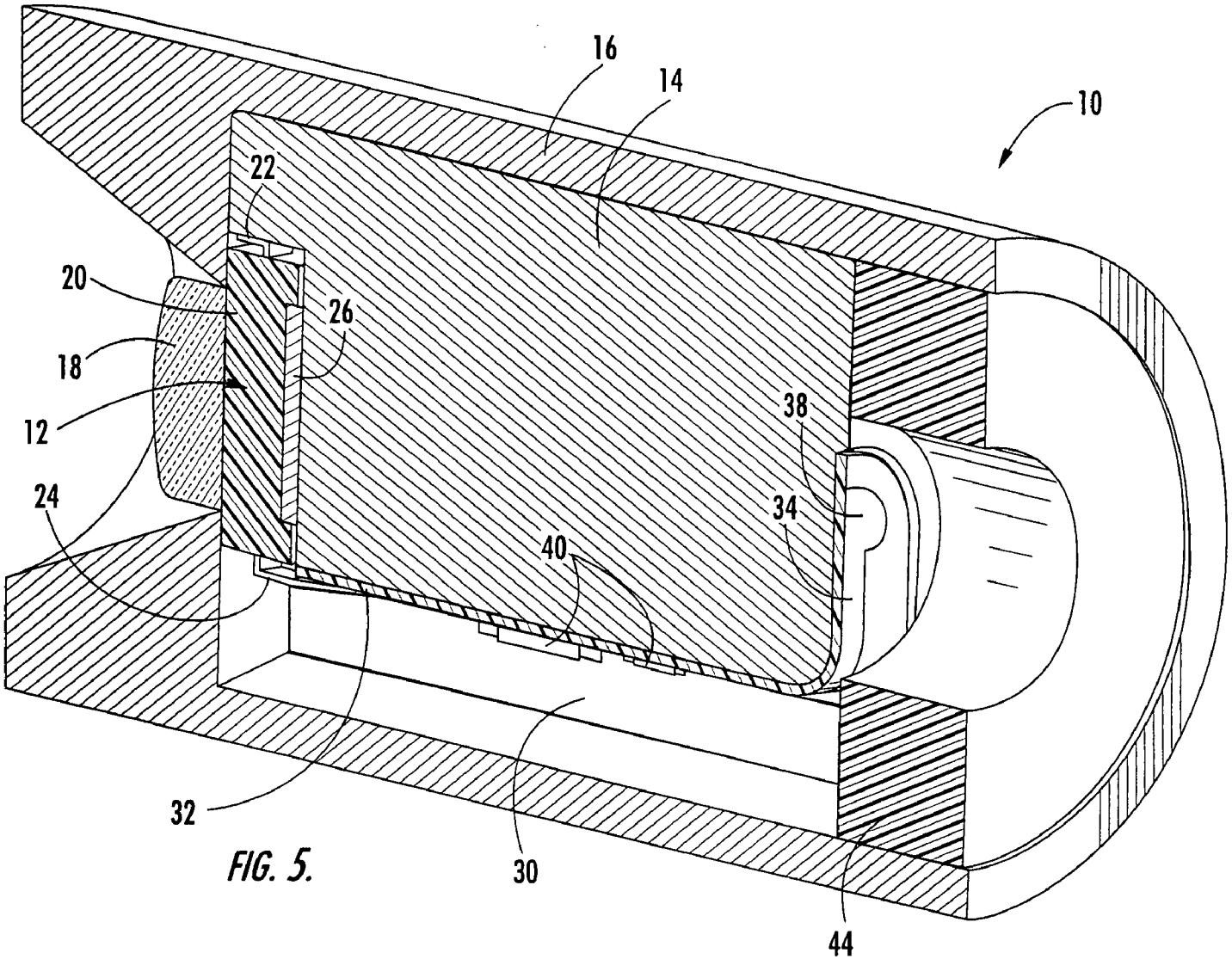
FIG. 5 is a cross-sectional view thereof as taken along line 5—5 of FIG. 1.
Figure 6:
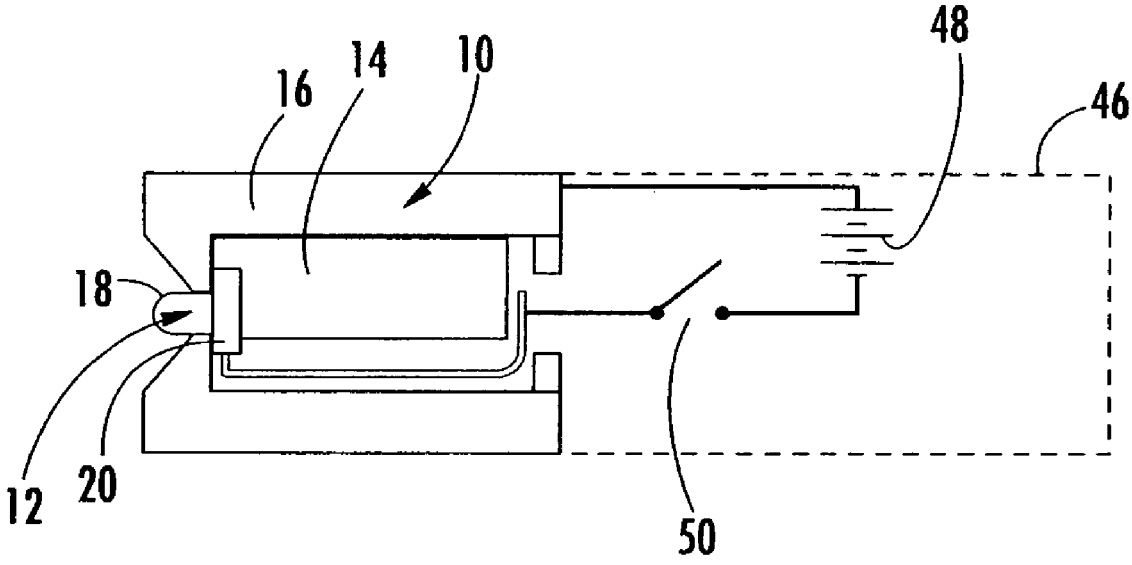
FIG. 6 is a schematic diagram generally illustrating the operational circuitry of present invention as incorporated into a complete lighting assembly.

Turning now to FIGS. 4 and 5, an exploded perspective view and a cross sectional view of the assembly 10 of the present invention can be seen. The assembly 10 of the present invention is specifically configured to incorporate a high intensity LED lamp 12 into a package that can be then used in a lighting assembly. The high intensity LED lamp 12 is shown here as a Luxeon Emitter assembly. However, it should be understood that the mounting arrangement described is equally applicable to other similarly packaged high intensity LED's. The LED 12 has a mounting base 20 and a clear optical lens 18 that encloses the LED 12 emitter chip (not shown). The LED 12 also includes two contact leads 22, 24 that extend from the sides of the mounting base 20, to which power is connected to energize the emitter chip. Further, the LED lamp 12 includes a heat transfer plate 26 positioned on the back of the mounting base 20. Since the emitter chip in this type of high intensity LED lamp 12 is four times the area of a standard emitter chip, a great deal more energy is consumed and a great deal more heat is generated. The heat transfer plate 26 is provided to transfer waste heat out of the LED lamp 12 to prevent malfunction or destruction of the chip. In this regard, the manufacturer has provided the heat transfer plate 26 for the specific purpose of engagement with a heat sink. However, all of the recommended heat sink configurations are directed to a planar circuit board mount with a heat spreader or a conventional finned heat sink. Neither of these arrangements is suitable for small package integration or a typical tubular flashlight construction.

In contrast, the mounting die 14 used in the present invention is configured to receive the LED lamp 12 and further provide both electrical and thermal conductivity to and from the LED lamp 12. The mounting die 14 is fashioned from a thermally conductive and electrically conductive material. In the preferred embodiment the mounting die 14 is fashioned from brass, however, the die 14 could also be fabricated from other metals such as aluminum or stainless steel or from an electrically conductive and thermally conductive polymer composition and still fall within the scope of this disclosure. The mounting die 14 has a recess 28 in one end thereof that is configured to frictionally receive and retain the base 20 of the LED lamp 12. While the base 20 and the recess 28 are illustrated as circular, it is to be understood that this recess is intended to receive the housing base regardless of the shape. As can be seen, one of the contact leads 22 extending from the base 20 of the LED lamp 12 must be bent against the LED lamp 12 base 20 and is thus trapped between the base 20 and the sidewall of the recess 28 when the LED lamp 12 is installed into the recess 28. When installed with the first contact lead 22 of the LED 12 retained in this manner, the lead 22 is in firm electrical communication with the mounting die 14. A channel 30 extends along one side of the mounting die 14 from the recess to the rear of the die 14. When the LED lamp 12 is installed in the mounting die 14, the second contact lead 24 extends into the opening in the channel 30 out of contact with the body of the mounting die 14. The heat transfer plate 26 provided in the rear of the LED lamp 12 base 20 is also in contact with the bottom wall of the recess 28 in the mounting die 14. When the heat transfer plate 26 is in contact with the die 14, the heat transfer plate 26 is also in thermal communication with the die 14 and heat is quickly transferred out of the LED lamp 12 and into the body of the die 14. The die 14 thus provides a great deal of added heat sink capacity to the LED lamp 12.

An insulator strip 32 is placed into the bottom of the channel 30 that extends along the side of the mounting die 14. The insulator strip 30 allows a conductor to be connected to the second contact lead 24 of the LED lamp 12 and extended through the channel 30 to the rear of the assembly 10 without coming into electrical contact with and short circuiting against the body of the die 14. In the preferred embodiment, the insulator strip 32 is a flexible printed circuit strip with circuit traces 34 printed on one side thereof. The second contact lead 24 of the LED lamp 12 is soldered to a contact pad 36 that is connected to a circuit trace 34 at one end of the insulator strip 32. The circuit trace 34 then extends the length of the assembly and terminated in a second contact pad 38 that is centrally located at the rear of the assembly 10. Further, control circuitry 40 may be mounted onto the flexible circuit strip 32 and housed within the channel 30 in the die 14. The control circuitry 40 includes an LED driver circuit as is well known in the art.

With the LED lamp 12 and insulator strip 32 installed on the mounting die 14, the mounting die 14 is inserted into the outer enclosure 16. The outer enclosure 16 is also fashioned from a thermally conductive and electrically conductive material. In the preferred embodiment the outer enclosure 16 is fashioned from brass, however, the outer enclosure 16 could also be fabricated from other metals such as aluminum or stainless steel or from an electrically conductive and thermally conductive polymer composition and still fall within the scope of this disclosure. The outer enclosure 16 has a cavity that closely matches the outer diameter of the mounting die 14. When the mounting die 14 is received therein, the die 14 and the housing 16 are in thermal and electrical communication with one another, providing a heat transfer pathway to the exterior of the assembly 10. As can also be seen, electrical connections to the assembly 10 can be made by providing connections to the outer enclosure 16 and the contact pad 38 on the circuit trace 34 at the rear of the mounting die 14. The outer enclosure 16 includes an aperture 42 in the front wall thereof through which the optical lens portion 18 of the LED lamp 12 extends. The aperture 42 is fashioned to provide optical control of the light emitted from the LED lamp 12. The aperture 42 in the preferred embodiment is shaped as a reflector cone and may be a simple conical reflector or a parabolic reflector. The walls of the aperture 42 may also be coated with an anti-reflective coating such as black paint or anodized to prevent the reflection of light, allowing only the image of the LED lamp 12 to be utilized in the finished lighting assembly.

Finally, an insulator disk 44 is shown pressed into place in the open end of the outer enclosure 16 behind the mounting die 14. The insulator disk 44 fits tightly into the opening in the outer enclosure 16 and serves to retain the mounting die 14 in place and to further isolate the contact pad 38 at the rear of the mounting die 14 from the outer enclosure 16.

Turning now to FIG. 6, a schematic diagram of a completed circuit showing the LED assembly 10 of the present invention incorporated into functional lighting device is provided. The LED assembly 10 is shown with electrical connections made thereto. A housing 46 is provided and shown in dashed lines. A power source 48 such as a battery is shown within the housing 46 with one terminal in electrical communication with the outer enclosure 15 of the LED assembly 10 and a second terminal in electrical communication with the circuit trace 38 at the rear of the housing 16 via a switch assembly 50. The switching assembly 50 is provided as a means of selectively energizing the circuit and may be any switching means already known in the art. The housing 46 of the lighting device may also be thermally and electrically conductive to provide additional heat sink capacity and facilitate electrical connection to the outer enclosure 16 of the LED assembly 10.

Figure 7:
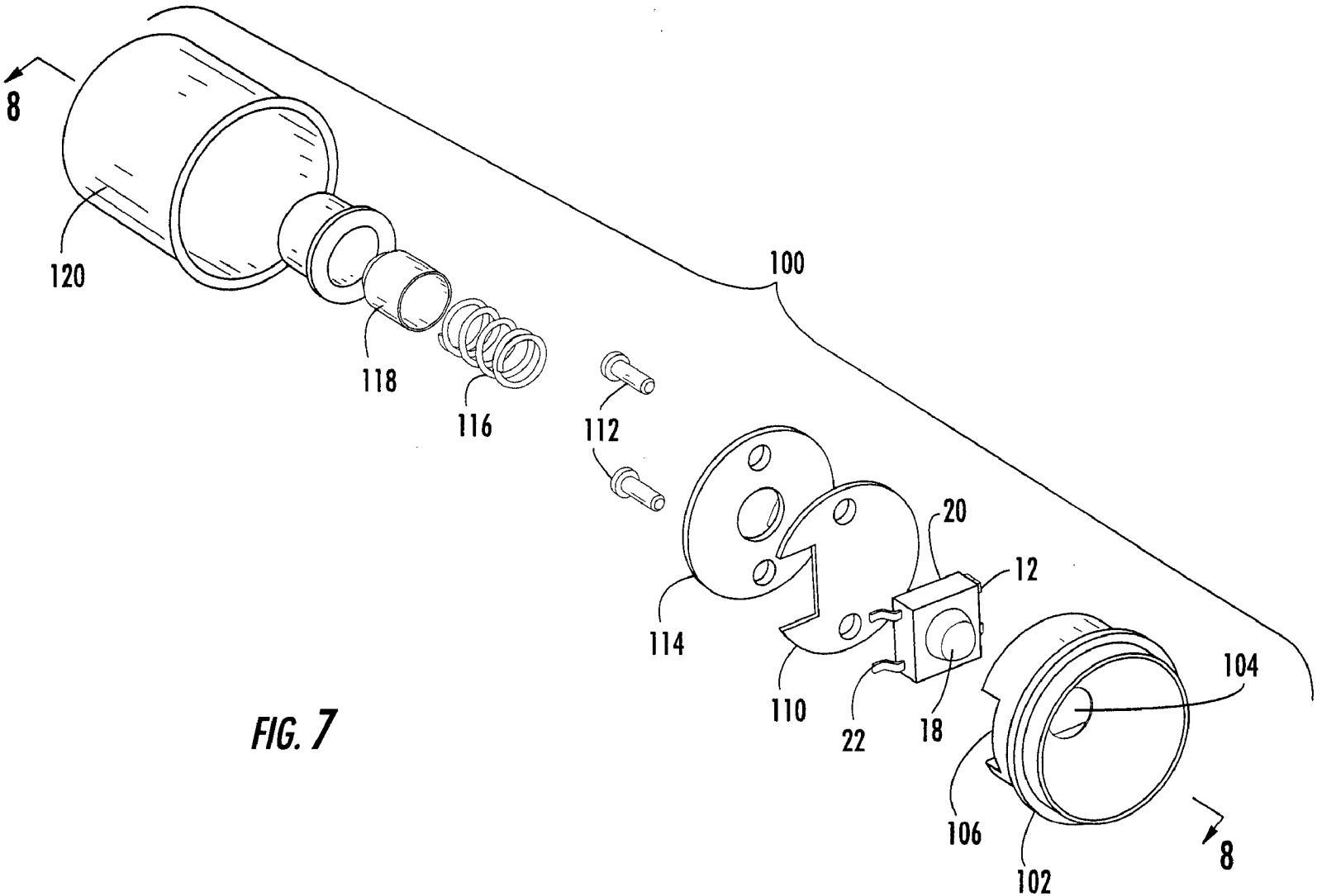
FIG. 7 is an exploded perspective view of a first alternate embodiment of the present invention.
Figure 8:
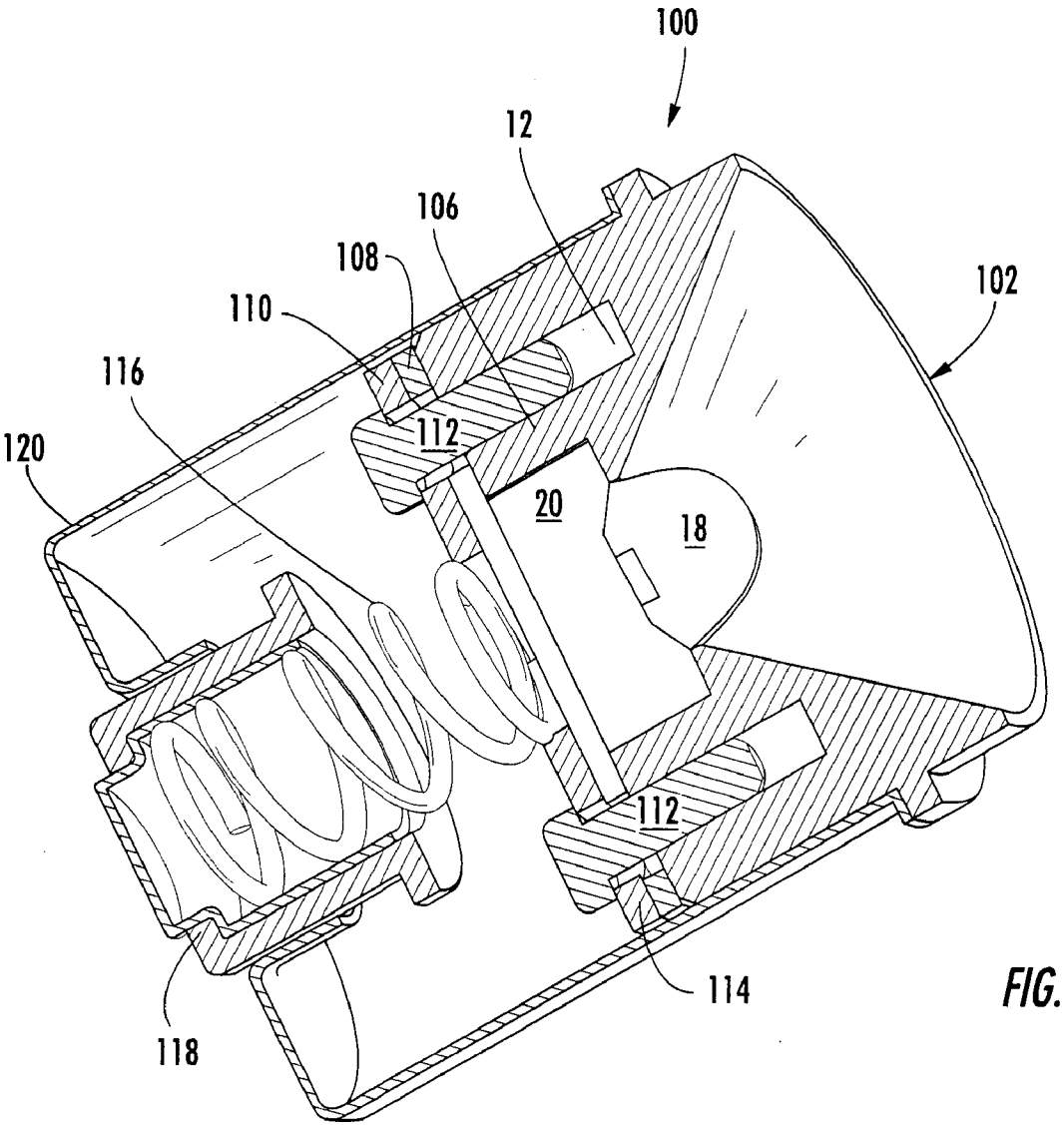
FIG. 8 is a cross-sectional view thereof as taken along line 8—8 of FIG. 7.

Turning to FIGS. 7 and 8, an alternate embodiment of the LED assembly 100 is shown the outer enclosure is a reflector cup 102 with an opening 104 in the center thereof. The luminescent portion 18 of the LED 12 is received in the opening 104. The reflector cup 102 includes a channel 106 that is cleared in the rear thereof to receive the mounting base 20 of the LED 12 wherein the rear surface of the mounting base 20 is substantially flush with the rear surface 108 of the reflector cup 102 when the LED in 12 is in the installed position. The mounting die is replaced by a heat spreader plate 110. The spreader plate 110 is in thermal communication with both the heat transfer plate on the back of the LED 12 and the rear surface 108 of the reflector cup 102. In this manner when the LED 12 is in operation the waste heat is conducted from the LED 12 through the spreader plate 110 and into the body of the reflector cup 102 for further conduction and dissipation. The spreader plate 110 may be retained in its operative position by screws 112 that thread into the back 108 of the reflector cup 102. Alternatively, a thermally conductive adhesive (not shown) may be used to hold the LED 12, the reflector cup 102 and the spreader plate 110 all in operative relation.

FIGS. 7 and 8 also show the installation of a circuit board 114 installed behind the spreader plate 110. The circuit board 114 is electrically isolated from the spreader plate 110 but has contact pads thereon where the electrical contacts 22 of the LED 12 can be connected. Further a spring 116 may be provided that extends to a plunger 118 that provides an means for bringing power from one battery contact into the circuit board 114. Power from the second contact of the power source may be conducted through the outer housing 120 and directed back to the circuit board. While specific structure is shown to complete the circuit path, it can be appreciated that the present invention is primarily directed to the assembly including merely the reflector cup 102, the LED 12 and the spreader plate 110.

Figure 9:
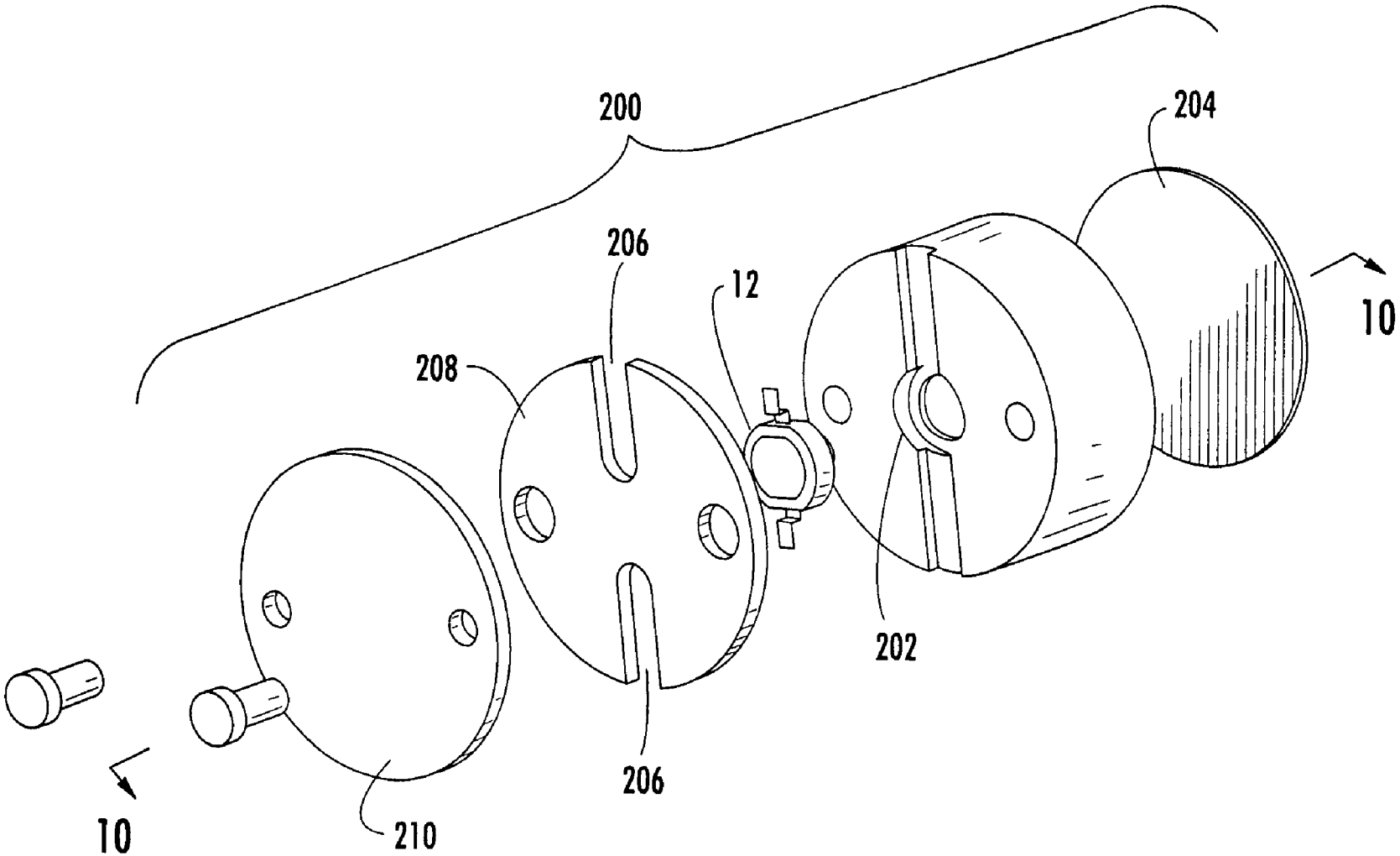
FIG. 9 is an exploded perspective view of a second alternate embodiment of the present invention.
Figure 10:
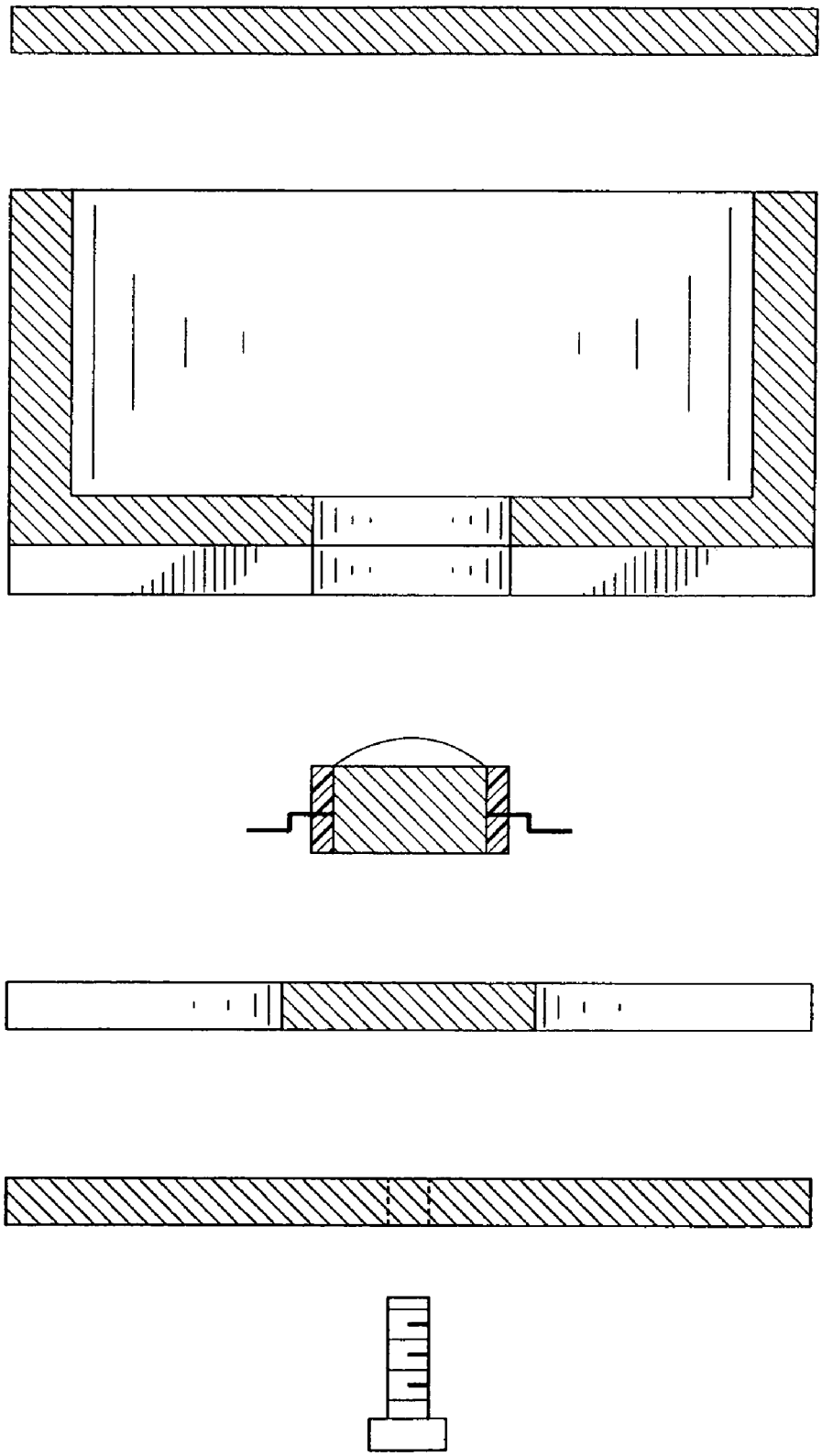
FIG. 10 is a cross-sectional view thereof as taken along line 10—10 of FIG. 9.

Turning now to FIGS. 9 and 10, a second alternate embodiment is shown where the slot is replaced with a circular hole 202 that receives a Luxeon type LED 12 emitter. Further, a lens 204 is shown for purposes of illustration. In all other respects this particular embodiment is operationally the same as the one described above. It should be note that relief areas 206 are provided in the spreader plate 208 that are configured to correspond to the electrical leads 22 of the LED 12 being used in the assembly. In this manner, the contacts 22 can be connected to the circuit board 210 without contacting the spreader plate 208.

Figure 11:
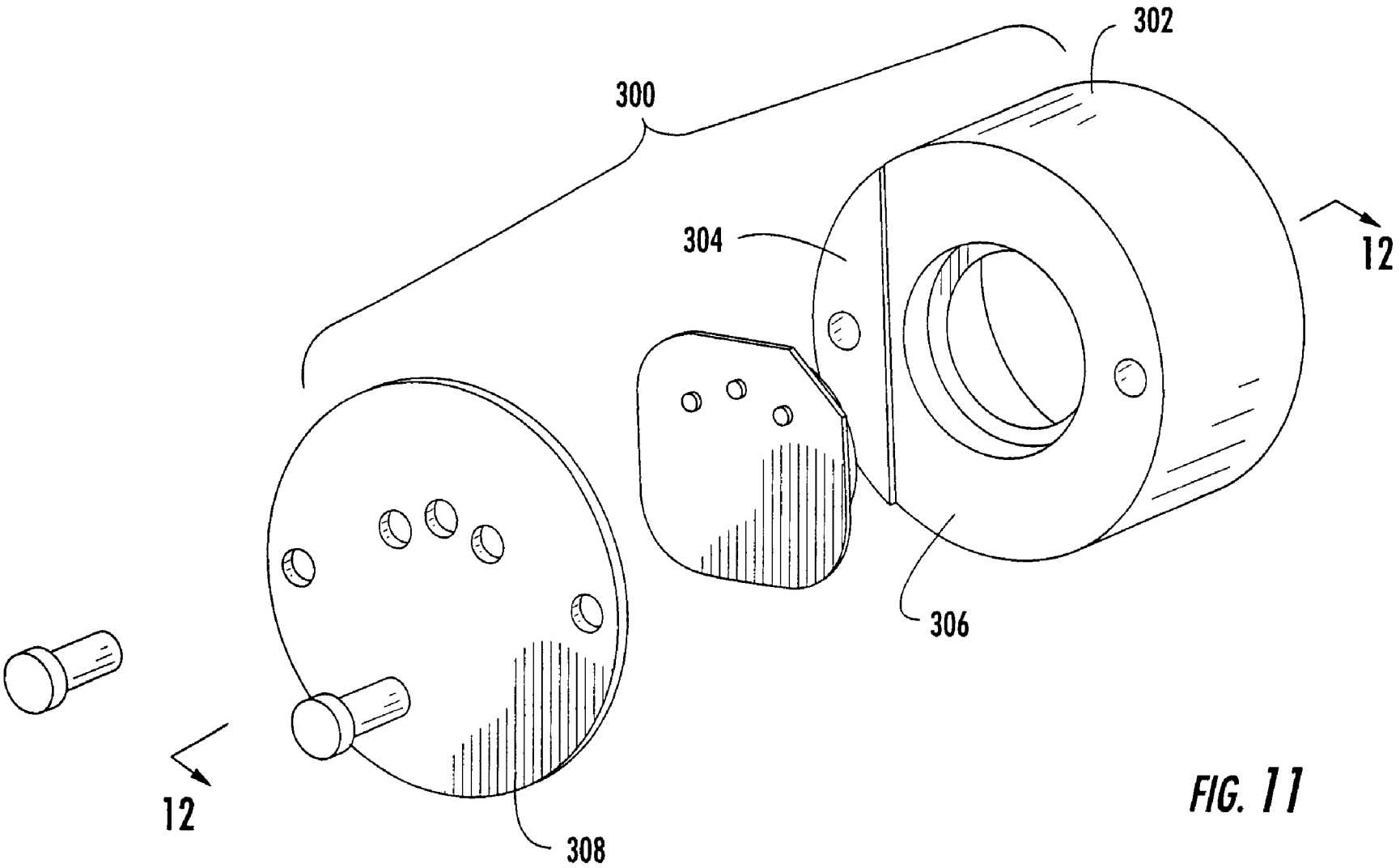
FIG. 11 is an exploded perspective view of a third alternate embodiment of the present invention.
Figure 12:
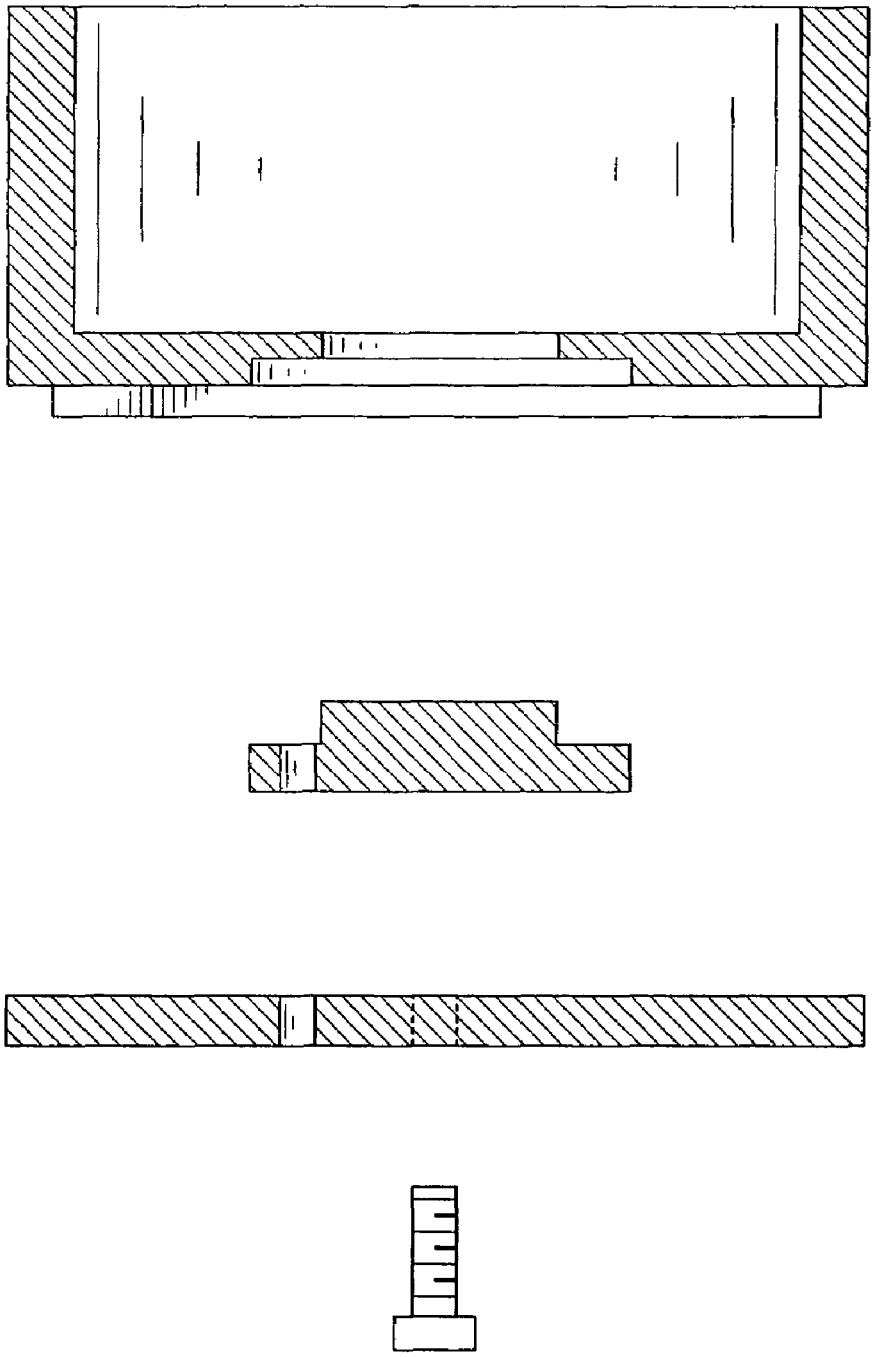
FIG. 12 is a cross-sectional view thereof as taken along line 12—12 of FIG. 11.

Turning to FIGS. 11 and 12, a third alternate embodiment of the LED assembly 300 is shown. The reflector cup 302 includes both a circular hole 304 and a slot 206 in the rear thereof. The important aspect of the present invention is that the spreader plates 110, 210 or 308 are in flush thermal communication with both the rear surface of the LED 12 and the rear surface of the reflector cups 102, 200 and 302 to allow the heat to be transferred from the LED 12 to the reflector cup 102, 200 and 302.

Figure 13:
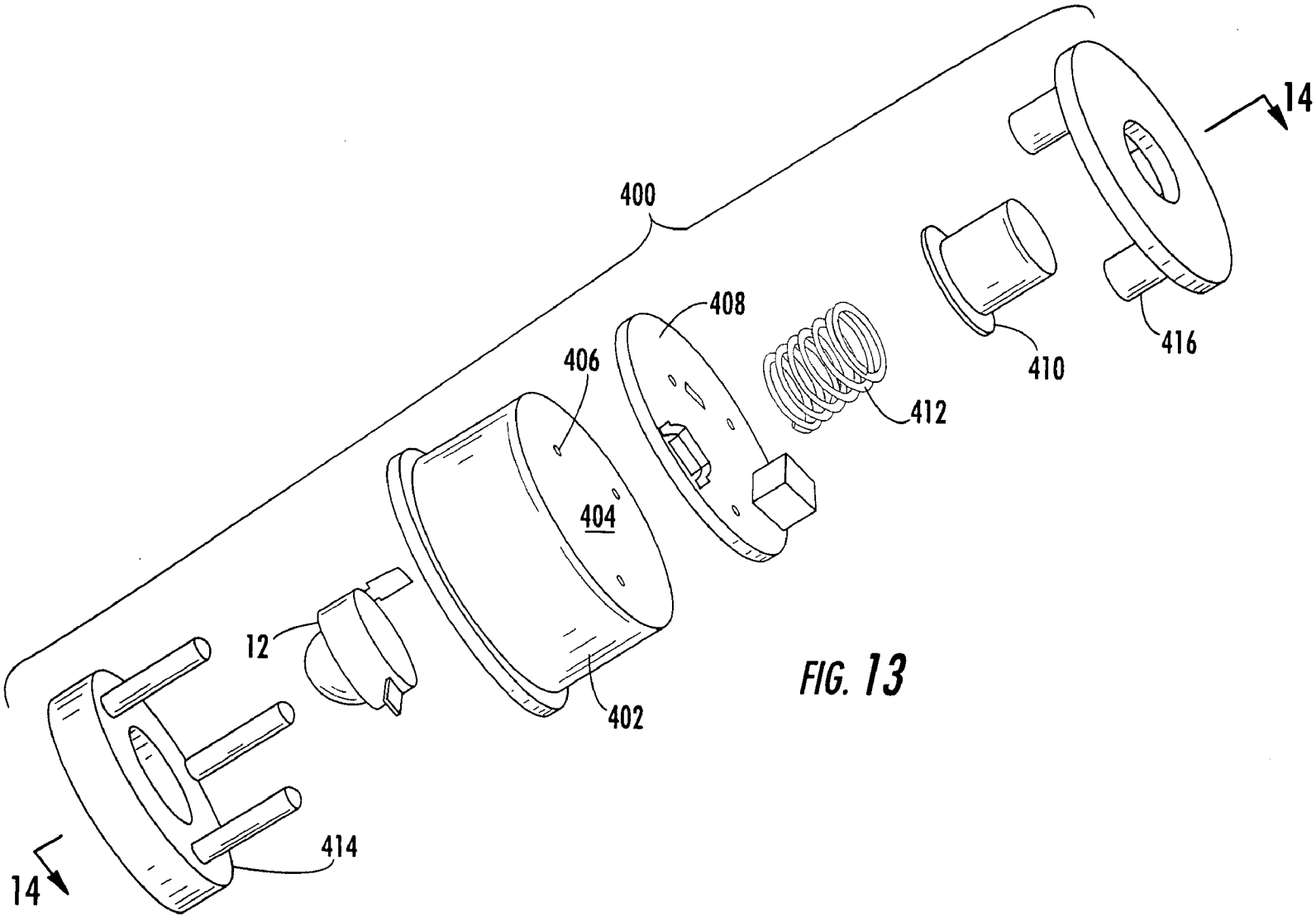
FIG. 13 is an exploded perspective view of a fourth alternate embodiment of the present invention.
Figure 14:
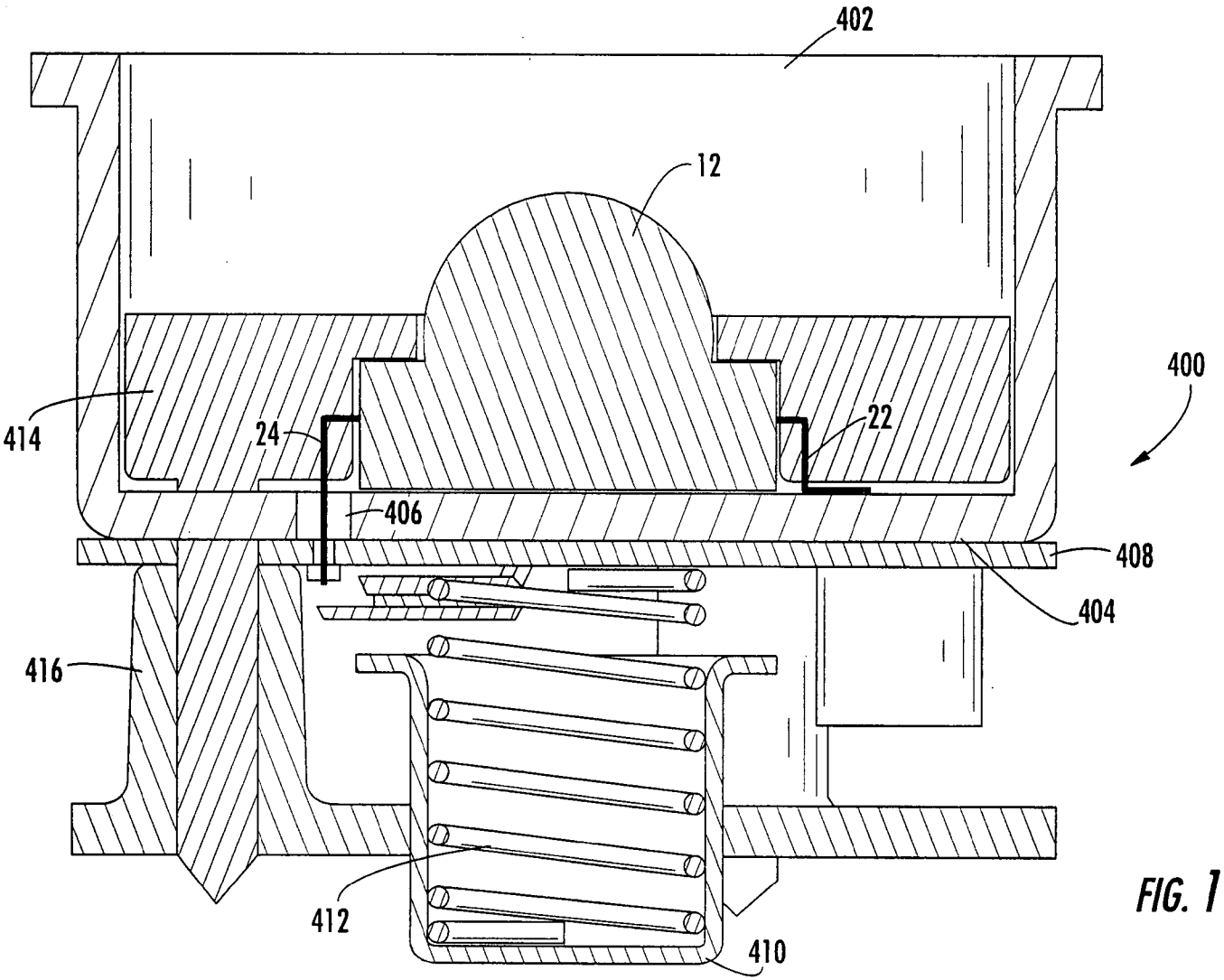
FIG. 14 is a cross-sectional view thereof as taken along line 14—14 of FIG. 13.

Turning to FIGS. 13 and 14, a fourth alternate embodiment of the LED assembly 400 is shown. The reflector cup 402 is configured to receive the entire LED 12 within the front of the reflector cup 402. The important aspect of the present invention is that the reflector cup 402 is metallic and thermal and electrically conductive. The rear surface of the LED 12 and one contact 22 thereof are in contact rear wall 404 of the reflector cup 402. In this manner, the reflector cup 402 provides both means for heat transfer from the LED 12 and electrical conductivity to one lead 22 of the LED 12. The second lead 24 of the LED 12 extends through a hole 406 in the reflector cup 402 and is in electrical communication with the circuit board 408. A battery contact 410 and spring 412 transfer electricity from one terminal of the power source to the rear of the circuit board 408 while power from the other terminal is introduced into the reflector cup 402 and to the front of the circuit board 408. The entire subassembly is connected together using plastic retainers 414 and 416 and heat staked together to provide a completed assembly 400.

It can therefore be seen that the present invention 10 provides a compact package assembly for incorporating a high intensity LED 12 into a lighting device. The present invention provides integral heat sink capacity and electrical connections that overcome the drawbacks associated with prior art attempts to use LED's of this type while further creating a versatile assembly 10 that can be incorporated into a wide range of lighting devices. For these reasons, the instant invention is believed to represent a significant advancement in the art, which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

The invention claimed is:

1. A light emitting diode assembly comprising:

a prepackaged light emitting diode assembly including:

a front luminescent portion, and a mounting base, said mounting base having a heat transfer plate on a rear surface thereof and a first and second electrical contact leads extending from the sides thereof;

a mounting die, said mounting die being thermally conductive, said mounting die having a bottom surface and a side wall extending upwardly from said bottom surface, said bottom surface and said side wall cooperating to form a cavity therein, wherein said prepackaged light emitting diode assembly is received in said cavity with said heat transfer plate in thermal communication with said bottom surface of said mounting die.

2. The light emitting diode assembly of claim 1, wherein said first contact lead of said prepackaged light emitting diode assembly is in electrical communication with said mounting die.

3. The light emitting diode assembly of claim 1, further comprising:

a hole in said rear surface of said mounting die corresponding to said second contact lead of said light emitting diode disposed to prevent said second contact lead of said prepackaged light emitting diode assembly from contacting said mounting die.

4. The light emitting diode assembly of claim 3, wherein said first contact lead of said prepackaged light emitting diode assembly is in electrical communication with said mounting die.

5. The light emitting diode assembly of claim 4, further comprising:

a circuit board adjacent to said mounting die, said circuit board in electrical communication with said second contact lead of said prepackaged light emitting diode assembly.

6. The light emitting diode assembly of claim 5, further comprising:

means for fastening said prepackaged light emitting diode assembly, said mounting die and said circuit board to form a single assembly.

7. A heat sink assembly for mounting a prepackaged light emitting diode assembly comprising:

a mounting die, said mounting die having a bottom wall and a side wall extending upwardly from said bottom wall, said side wall and said bottom wall cooperating to form an interior cavity, said interior cavity being configured to receive a prepackaged light emitting diode assembly, wherein a luminescent portion of said prepackaged light emitting diode assembly directs light output outwardly from said cavity; and means for conducting heat from said prepackaged light emitting diode assembly to said mounting die.

8. The heat sink assembly of claim 7, wherein said means for conducting heat is a heat transfer plate on a rear surface of said prepackaged light emitting diode assembly, said heat transfer plate being in thermal communication with said bottom wall of said mounting die.

9. The light emitting diode assembly of claim 7, further comprising:

means for fastening said prepackaged light emitting diode assembly to said mounting die to form a single assembly.

10. A flashlight assembly comprising:

at least one battery, said battery having a first electrical contact and a second electrical contact;

a flashlight head assembly connected to said at least one battery and including, a prepackaged light emitting diode assembly having a front luminescent portion and a rear mounting base, said mounting base having a heat transfer plate on a rear surface thereof and a first and second contact lead extending from the sides thereof, a mounting die, said mounting die being thermally conductive, said mounting die having a bottom surface and a side wall extending upwardly from said bottom surface, said bottom surface and said side wall cooperating to form a cavity therein, wherein said prepackaged light emitting diode assembly is received in said cavity with said heat transfer plate in thermal communication with said bottom surface of said mounting die, wherein said mounting die conducts heat away from said light emitting diode, an exterior enclosure; and means for selectively energizing said prepackaged light emitting diode assembly disposed between and in electrical communication with said first and second contacts of said battery and said first and second contacts on said prepackaged light emitting diode assembly.

* * * * *